US011847954B2

(12) United States Patent
Dong

(10) Patent No.: US 11,847,954 B2
(45) Date of Patent: Dec. 19, 2023

(54) PIXEL CIRCUITRY AND CONTROL METHOD THEREOF, AND DISPLAY DEVICE

(71) Applicant: BOE Technology Group Co., Ltd., Beijing (CN)

(72) Inventor: Tian Dong, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 98 days.

(21) Appl. No.: 17/600,078

(22) PCT Filed: Feb. 2, 2021

(86) PCT No.: PCT/CN2021/074899
§ 371 (c)(1),
(2) Date: Sep. 29, 2021

(87) PCT Pub. No.: WO2021/190156
PCT Pub. Date: Sep. 30, 2021

(65) Prior Publication Data

US 2022/0189378 A1 Jun. 16, 2022

(30) Foreign Application Priority Data

Mar. 27, 2020 (CN) ..... 202010228173.4

(51) Int. Cl.
*G09G 3/20* (2006.01)

(52) U.S. Cl.
CPC ... *G09G 3/2092* (2013.01); *G09G 2300/0452* (2013.01); *G09G 2310/0278* (2013.01)

(58) Field of Classification Search
CPC ..... G09G 3/3208; G09G 2300/0439–0465; G09G 2310/0297; H04M 1/0266
See application file for complete search history.

(56) References Cited

U.S. PATENT DOCUMENTS

2007/0057877 A1 3/2007 Choi et al.
2015/0061983 A1* 3/2015 Kim ..... G09G 3/3275 345/82
2016/0217744 A1 7/2016 Song et al.

FOREIGN PATENT DOCUMENTS

CN 1932939 A 3/2007
CN 110517636 A 11/2019
(Continued)

OTHER PUBLICATIONS

CN2020102281734 first office action.
PCT/CN2021/074899 international search report and written opinion.

*Primary Examiner* — Benjamin C Lee
*Assistant Examiner* — Nathan P Brittingham
(74) *Attorney, Agent, or Firm* — IPro, PLLC

(57) ABSTRACT

Provided are a pixel circuitry, a control method thereof and a display device. The pixel circuitry includes: a plurality of sub-pixels arranged in an array; a plurality of gate lines extending in a first direction, where all sub-pixels located in one row are electrically coupled to one gate line; a plurality of first signal lines and a plurality of second signal lines extending in a second direction, where all sub-pixels located in odd-numbered rows and one column are electrically coupled to one first signal line, and all sub-pixels located in even-numbered rows and one column are electrically coupled to one second signal line, the second direction being perpendicular to the first direction; and a plurality of data lines extending in the second direction, where two first signal lines and two second signal lines coupled to two adjacent columns of sub-pixels are electrically coupled to one data line.

9 Claims, 6 Drawing Sheets

(56) References Cited

FOREIGN PATENT DOCUMENTS

| | | | |
|---|---|---|---|
| CN | 110808005 | A | 2/2020 |
| CN | 111292665 | A | 6/2020 |
| CN | 111627393 | A | 9/2020 |

* cited by examiner

PIXEL CIRCUITRY AND CONTROL METHOD THEREOF, AND DISPLAY DEVICE

CROSS-REFERENCE TO RELATED APPLICATIONS

This application is the U.S. national phase of PCT Application No. PCT/CN2021/074899 filed on Feb. 2, 2021, which claims a priority to Chinese Patent Application No. 202010228173.4 filed in China on Mar. 27, 2020. Disclosures of both the applications are incorporated herein by reference in their entireties.

TECHNICAL FIELD

The present disclosure relates to the field of display technologies, and more particularly, to a pixel circuitry and a control method thereof, and a display device.

BACKGROUND

With the continuous development of science and technology, people spend more and more time for entertainment and work through display devices, and accordingly have higher and higher requirements for a screen resolution of the display devices. For example: in order to meet the display requirements of virtual reality (Virtual Reality, VR) games or augmented reality (Augmented Reality, AR) games, it is necessary to continuously improve the screen resolution of the display devices.

In the related art, in the process of increasing the screen resolution of the display devices, the number of signal lines in a pixel circuitry also increases, a case where the number of signal lines is greater than the number of channels of a single integrated circuit (Integrated Circuit, IC) occurs, and a problem that the number of channels of the IC is insufficient occurs.

SUMMARY

Embodiments of the present disclosure provide a pixel circuitry, a control method thereof, and a display device.

In a first aspect, embodiments of the present disclosure provide a pixel circuitry, which includes:

a plurality of sub-pixels arranged in an array;

a plurality of gate lines extending in a first direction, wherein all sub-pixels located in a same row are electrically coupled to a same one of the gate lines;

a plurality of first signal lines and a plurality of second signal lines that extend in a second direction, wherein all sub-pixels located in odd-numbered rows and a same column are electrically coupled to a same one of the first signal lines, and all sub-pixels located in even-numbered rows and a same column are electrically coupled to a same one of the second signal lines, the second direction being perpendicular to the first direction; and a plurality of data lines extending in the second direction, wherein two of the first signal lines and two of the second signal lines that are coupled to two adjacent columns of the sub-pixels are electrically coupled to a same one of the data lines.

Further, a first switch circuit is provided between each of the data lines and one of the first signal lines coupled to the data line, and a second switch circuit is provided between each of the data lines and one of the second signal lines coupled to the data line; each first switch circuit is configured to control connection or disconnection between the data line and the first signal line that are coupled; and each second switch circuit is configured to control connection or disconnection between the data line and the second signal line that are coupled.

Further, the pixel circuitry further includes four control signal lines extending in the first direction, wherein two of the control signal lines are respectively electrically coupled to control terminals of two first switch circuits coupled to a same data line of the data lines, and the other two control signal lines are respectively electrically coupled to control terminals of two second switch circuits coupled to a same data line of the data lines; and the four control signal lines are configured to control, in a time-sharing manner, connection or disconnection between each data line and the first signal lines or the second signal lines that are coupled to the data line.

Further, one of the first signal lines and one of the second signal lines are provided between two columns of sub-pixels that are coupled.

Further, a third switch circuit is further provided between two first switch circuits coupled to a same data line of the data lines and the data line, and a fourth switch circuit is further provided between two second switch circuits coupled to a same data line of the data lines and the data line; the third switch circuit is configured to control connection or disconnection between the data line and the two first switch circuits; and the fourth switch circuit is configured to control connection or disconnection between the data line and the two second switch circuits.

Further, the pixel circuitry further includes a first control signal line, a second control signal line, a third control signal line, and a fourth control signal line that extend in the first direction. The first control signal line is electrically coupled to a control terminal of the third switch circuit of each data line; the second control signal line is electrically coupled to a control terminal of the fourth switch circuit of each data line; the third control signal line is electrically coupled to control terminals of first switch circuits coupled to sub-pixels located in the odd-numbered rows and the odd-numbered columns, and to control terminals of second switch circuits coupled to sub-pixels located in the even-numbered rows and the even-numbered columns; and the fourth control signal line is electrically coupled to control terminals of the second switch circuit coupled to sub-pixels located in the even-numbered rows and the odd-numbered columns, and to control terminals of first switch circuits coupled to sub-pixels located in the odd-numbered rows and the even-numbered columns.

Further, two of the first signal lines or two of the second signal lines are provided between two adjacent columns of sub-pixels.

Further, among two columns of sub-pixels corresponding to one of the data lines, a fifth switch circuit is further provided between the data line and a first switch circuit and a second switch circuit that are coupled to one column of sub-pixels, and a sixth switch circuit is further provided between the data line and a first switch circuit and a second switch circuit that are coupled to the other column of sub-pixels; the fifth switch circuit is configured to control connection or disconnection between the data line, and the first switch circuit or second switch circuit that is coupled to the fifth switch circuit; and the sixth switch circuit is configured to control connection or disconnection between the data line, and the first switch circuit or second switch circuit that is coupled to the sixth switch circuit.

Further, the pixel circuitry further includes a first control signal line, a second control signal line, a third control signal line, and a fourth control signal line that extend in the first direction, wherein: the first control signal line is electrically coupled to a control terminal of the fifth switch circuit of each data line; the second control signal line is electrically coupled to a control terminal of the sixth switch circuit of each data line; the third control signal line is electrically coupled to control terminals of first switch circuits coupled to sub-pixels located in the odd-numbered rows and the odd-numbered columns, and to control terminals of second switch circuits coupled to sub-pixels located in the odd-numbered rows and the even-numbered columns; and the fourth control signal line is electrically coupled to control terminals of first switch circuits coupled to sub-pixels located in the even-numbered rows and the odd-numbered columns, and to control terminals of second switch circuits coupled to sub-pixels located in the even-numbered rows and the even-numbered columns.

Further, at least one of the first switch circuit, the second switch circuit, the third switch circuit or the fourth switch circuit includes a transistor, a first electrode of the transistor is electrically coupled to the data line, a second electrode of the transistor is electrically coupled to the sub-pixels, and a control electrode of the transistor is electrically coupled to a control signal line.

In a second aspect, embodiments of the present disclosure also provide a display device, including the pixel circuitry as described above.

In a third aspect, embodiments of the present disclosure also provide a method for driving a pixel circuitry, applied to the pixel circuitry as described above. The method includes: providing, by the plurality of gate lines in a time-sharing manner, gate scanning signals to sub-pixels located in different rows, wherein the providing the gate scanning signals to a row of sub-pixels includes: providing, by each of the data lines in the time-sharing manner, corresponding data signals to two sub-pixels in the row of sub-pixels via a first signal line or a second signal line coupled to the data line.

Further, in case of providing the gate scanning signals to an odd-numbered row of sub-pixels, the providing, by each of the data lines in the time-sharing manner, corresponding data signals to two sub-pixels in the row of sub-pixels via a first signal line or a second signal line coupled to the data line includes: controlling the first control signal line to send a turned-on signal to the control terminal of the third switch circuit, and simultaneously controlling the third control signal line to send a turned-on signal to the control terminal of the first switch circuit, to enable the data signals to be written into sub-pixels located in the odd-numbered row and the odd-numbered columns; and controlling the first control signal line to send the turned-on signal to the control terminal of the third switch circuit, and simultaneously controlling the fourth control signal line to send the turned-on signal to the control terminal of the first switch circuit, to enable the data signals to be written into sub-pixels located in the odd-numbered row and the even-numbered columns. Alternatively, in case of providing the gate scanning signals to an even-numbered row of sub-pixels, the providing, by each of the data lines in the time-sharing manner, corresponding data signals to two sub-pixels in the row of sub-pixels via a first signal line or a second signal line coupled to the data line includes: controlling the second control signal line to send a turned-on signal to the control terminal of the fourth switch circuit, and simultaneously controlling the fourth control signal line to send a turned-on signal to the control terminal of the second switch circuit, to enable the data signals to be written into sub-pixels located in the even-numbered row and the odd-numbered columns; and controlling the second control signal line to send the turn-on signal to the control terminal of the fourth switch circuit, and simultaneously controlling the third control signal line to send the turn-on signal to the control terminal of the second switch circuit, to enable the data signals to be written to sub-pixels located in the even-numbered row and even-numbered columns.

Further, in case of providing the gate scanning signals to an odd-numbered row of sub-pixels, the providing, by each of the data lines in the time-sharing manner, corresponding data signals to two sub-pixels in the row of sub-pixels via a first signal line or a second signal line coupled to the data line includes: controlling the first control signal line to send a turn-on signal to the control terminal of the fifth switch circuit, and simultaneously controlling the third control signal line to send a turn-on signal to the control terminal of the first switch circuit, to enable the data signals to be written into sub-pixels located in the odd-numbered row and the odd-numbered columns; and controlling the second control signal line to send the turn-on signal to the control terminal of the sixth switch circuit, and simultaneously controlling the third control signal line to send the turn-on signal to the control terminal of the first switch circuit, to enable the data signals to be written into sub-pixels located in the odd-numbered row and the even-numbered columns. Alternatively, in case of providing the gate scanning signals to an even-numbered row of sub-pixels, the providing, by each of the data lines in the time-sharing manner, corresponding data signals to two sub-pixels in the row of sub-pixels via a first signal line or a second signal line coupled to the data line includes: controlling the first control signal line to send a turn-on signal to the control terminal of the fifth switch circuit, and simultaneously controlling the fourth control signal line to send a turn-on signal to the control terminal of the second switch circuit, to enable the data signals to be written into sub-pixels located in the even-numbered row and the odd-numbered columns; and controlling the second control signal line to send the turn-on signal to the control terminal of the sixth switch circuit, and simultaneously controlling the fourth control signal line to send the turn-on signal to the control terminal of the second switch circuit, to enable the data signals to be written to sub-pixels located in the even-numbered row and the even-numbered columns.

DESCRIPTION OF EMBODIMENTS

The technical solution of embodiments of the present disclosure will be described clearly and fully hereinafter with reference to the accompanying drawings of the embodiments of the present disclosure. Apparently the described embodiments are a part of the embodiments of the present disclosure, but not all of the embodiments. Based on the embodiments of the present disclosure, all other embodiments obtained by a person of ordinary skill in the art without inventive effort shall fall within the protection scope of the present disclosure.

Figure 1:
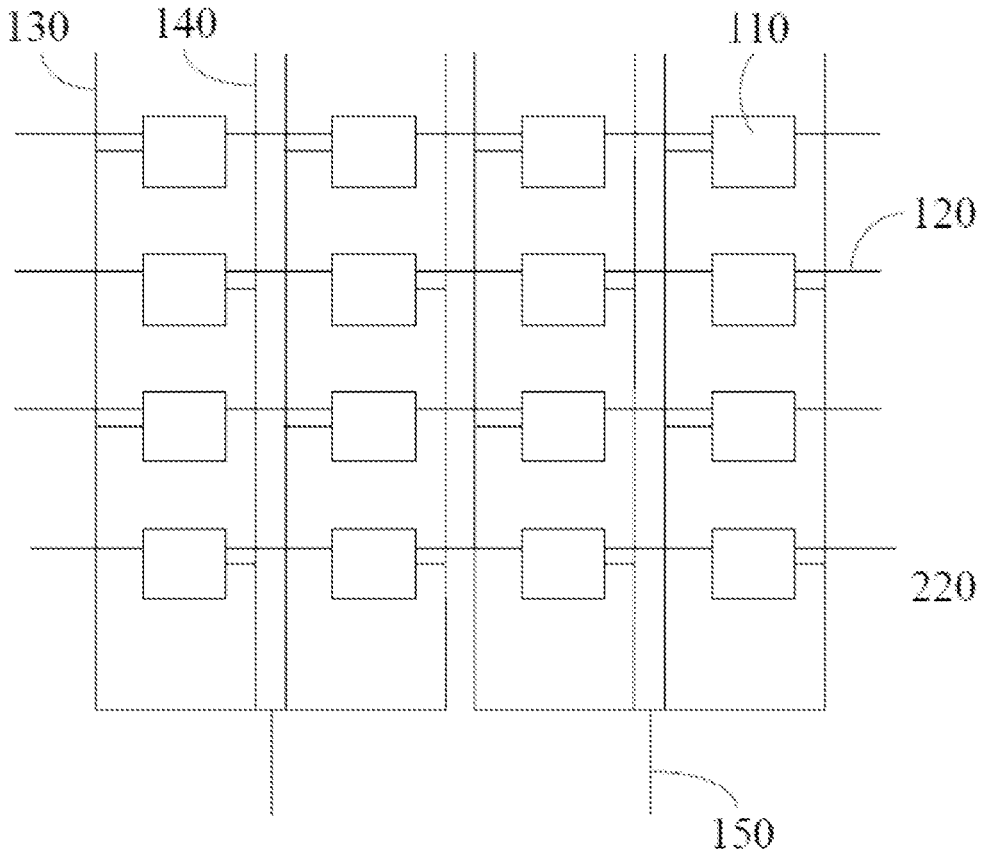
FIG. 1 is a schematic structural diagram of a pixel circuitry provided by an embodiment of the present disclosure.

An embodiment of the present disclosure provides a pixel circuitry, as shown in FIG. 1, including:

a plurality of sub-pixels 110 arranged in an array;

a plurality of gate lines 120 extending in a first direction, wherein all sub-pixels 110 located in a same row are electrically coupled to a same gate line 120;

a plurality of first signal lines 130 and a plurality of second signal lines 140 that extend in a second direction, wherein all sub-pixels 110 located in odd-numbered rows and a same column are electrically coupled to a same first signal line 130; all sub-pixels 110 located in even-numbered rows and a same column are electrically coupled to a same second signal line 140, and the second direction is perpendicular to the first direction; and a plurality of data lines 150 extending in the second direction, wherein two first signal lines 130 and two second signal lines 140 coupled to sub-pixels 120 located in two adjacent columns are electrically coupled to a same data line 150.

In the embodiment of the present disclosure, all the sub-pixels located in odd-numbered rows and the same column are electrically coupled to the same first signal line, all the sub-pixels located in even-numbered rows and the same column are electrically coupled to the same second signal line, and two first signal lines and two second signal lines coupled to sub-pixels located in two adjacent columns are all electrically coupled to the same data line, so that one data line can charge two columns of sub-pixels, thereby avoiding the situation where the number of channels is insufficient when the IC provides data signals and facilitating the development of display devices with high resolution. Therefore, the technical solutions provided by the present disclosure can avoid the situation of insufficient number of channels when data signals are supplied by the IC, thereby facilitating the development of the display devices with high resolution.

The above plurality of sub-pixels 110 arranged in an array may be a plurality of sub-pixels of different colors arranged in the array on a substrate according to a preset sequence, and may include a red sub-pixel, a green sub-pixel, and a blue sub-pixel, and certainly may also include sub-pixels of other colors, for example, white sub-pixels, yellow sub-pixels, etc., which are not limited herein.

The number of the above-mentioned gate lines 120 is equal to the number of rows of the sub-pixels 110 arranged in the array, and multiple rows of sub-pixels are coupled to the gate lines 120 in one-to-one manner. In an embodiment of the present disclosure, the first direction is the same as the row direction in which the sub-pixels 110 are arranged.

The number of the above-mentioned first signal lines 130 is equal to the number of the above-mentioned second signal lines 140, and is equal to the number of columns of sub-pixels 110 arranged in the array. For each column of sub-pixels, the sub-pixels located in the odd-numbered rows are electrically coupled to the first signal line 130, and the sub-pixels located in the even-numbered rows are electrically coupled to the second signal line 140. In an embodiment of the present disclosure, the second direction is the same as the column direction in which the sub-pixels 110 are arranged.

The above-mentioned data lines 150 are located at one side of the plurality of sub-pixels arranged in the array in the column direction, and each data line 150 is coupled to two first signal lines 130 and two second signal lines 140 through a node; the four coupled signal lines provide data signals to each sub-pixels of the two columns of sub-pixels corresponding to the data line 150.

The four signal lines coupled to the same data line 150 transmit a data signal Vdata on the data line 150 in a time-divided way, namely, one signal line obtains the data signal Vdata on the data line 150, while the other three signal lines do not obtain the data signal Vdata on the data line 150.

Figure 2:
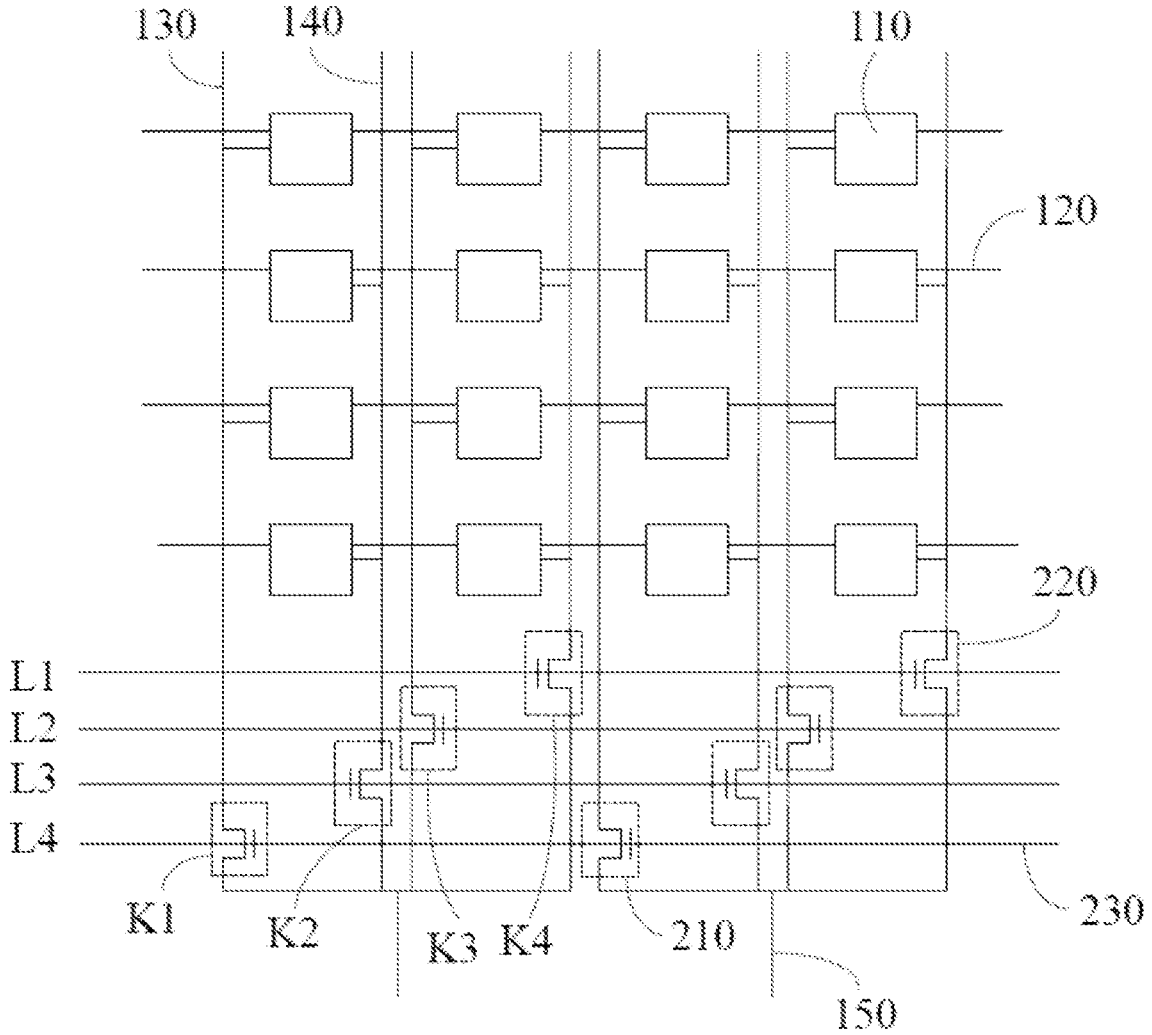
FIG. 2 is a schematic structural diagram of a pixel circuitry provided by another embodiment of the present disclosure.

In an optional embodiment of the present disclosure, as shown in FIG. 2, a first switch circuit 210 is provided between each data line 150 and the first signal line 130 coupled to the data line, and a second switch circuit 220 is provided between each data line 150 and the second signal line 140 coupled to the data line. Each first switch circuit 210 is configured to control connection or disconnection between the data line 150 and the first signal line 130 that are coupled to the first switch circuit; and each second switch circuit 220 is configured to control connection or disconnection between the data line 150 and the second signal line 140 that are coupled to the second switch circuit.

Namely, in the embodiments, a first terminal of each first switch circuit 210 is electrically coupled to the data line 150, and a second terminal is electrically coupled to the first signal line 130; and a first terminal of each second switch circuit 220 is electrically coupled to the data line 150, and a second terminal is electrically coupled to the second signal line 140. One of the data lines 150 is connected to two of the first switch circuits 210 and two of the second switch circuits 220.

Four switch circuits operate in a time-sharing manner, one of the switch circuits operating refers to conducting the connection between the data line 150 and the first signal line 130 or the second signal line 140 that are connected to the one switch circuit; the other switch circuits disconnect the coupled data lines 150 from the first signal lines 130 or second signal lines 140 that are connected to the other switch circuits, thereby to realize that the four signal lines transmit the data signal Vdata on the data line 150 in the time-sharing manner.

In an optional embodiment, as shown in FIG. 2, the pixel circuitry may further include four control signal lines 230 extending in the first direction, wherein two of the control signal lines 230 are electrically coupled, in one-to-one corresponding manner, to control terminals of two first switch circuits 210 coupled to each of the data lines 150; the other two of the control signal lines 230 are electrically coupled, in one-to-one corresponding manner, to control terminals of two second switch circuits 220 coupled to each of the data lines 150. The four control signal lines 230 are configured to control, in a time-sharing manner, the connection or disconnection between each of the data lines 150 and the first signal lines 130 or the second signal lines 140 that are coupled to the data line.

In the embodiment, four control signal lines 230 are electrically connected to two first switch circuits 210 and two second switch circuits 220, respectively, and the control signal lines 230 is electrically coupled to the control terminals of the respective coupled switch circuits for controlling the respective coupled switch circuits to operate in the time-sharing manner.

When one of the control signal lines 230 provides an enable signal so that the switch circuit coupled thereto operates, the remaining three control signal lines 230 provide a disable signal so that the switch circuits coupled to the remaining three control signal lines 230 do not operate, thereby realizing a control of a time-sharing operation of the four switch circuits.

As shown in FIG. 2, four control signal lines 230 are numbered from top to bottom in FIG. 2 as the first control signal line L1, the second control signal line L2, the third control signal line L3, and the fourth control signal line L4, respectively. The four switch circuits coupled to the left data line 150 in FIG. 2 are respectively numbered from left to right as the first switch circuit K1, the second switch circuit K2, the third switch circuit K3, and the fourth switch circuit K4. The control terminal of the first switch circuit K1 is electrically coupled to the fourth control signal L4, the control terminal of the second switch circuit K2 is electrically coupled to the third control signal L3, the control terminal of the third switch circuit K3 is electrically coupled to the second control signal L2, and the control terminal of the fourth switch circuit K4 is electrically coupled to the first control signal line L1.

Figure 3:
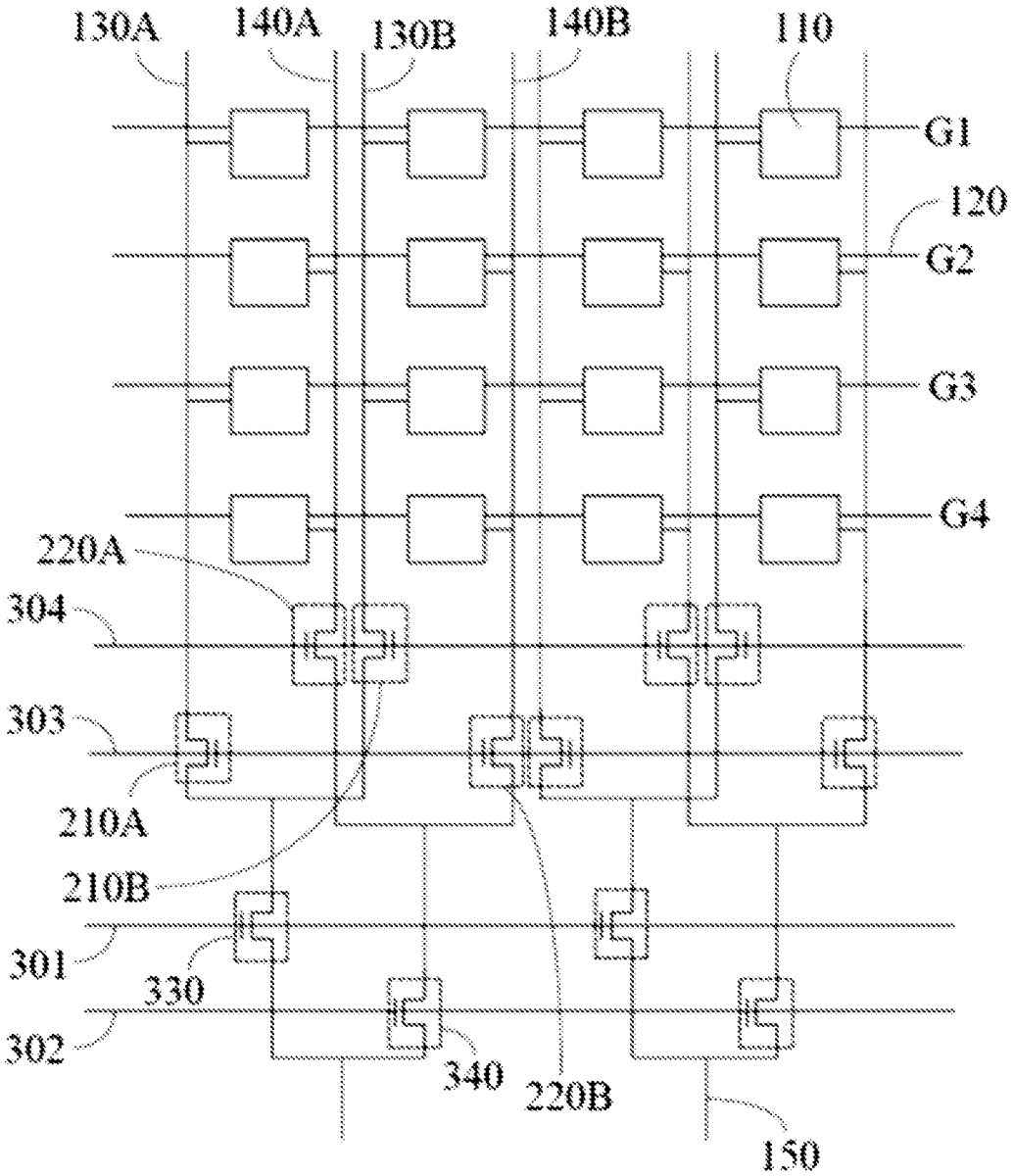
FIG. 3 is a schematic structural diagram of a pixel circuitry provided by another embodiment of the present disclosure.

In an optional embodiment, as shown in FIG. 3, one first signal line 130 and one second signal line 140 may be provided between any two adjacent columns of sub-pixels.

Referring to FIG. 3, a third switch circuit 330 is further provided between two first switch circuits 210 coupled to each data line and the data line, and a fourth switch circuit 340 is further provided between two second switch circuits 220 coupled to each data line and the data line. The third switch circuit 330 is configured to control connection or disconnection between the data line 150 and two first switch circuits 210; and the fourth switch circuit 340 is configured to control connection or disconnection between the data line 150 and the two second switch circuits 220.

In the embodiments, connections or disconnections between the four signal lines and the data line are controlled by two-stage switches. Specifically, a first terminal of the third switch circuit 330 is electrically coupled to the data line 150, and a second terminal of the third switch circuit 330 is electrically coupled to first terminals of the two first switch circuits 210; a first terminal of the fourth switch circuit 340 is electrically coupled to the data line 150, and a second terminal of the fourth switch circuit 340 is electrically coupled to first terminals of the two second switch circuits 220.

When the third switch circuit 330 works, the fourth switch circuit 340 does not work, namely, when the third switch circuit 330 turns on the connection between the data line 150 and the two first switch circuits 210, the fourth switch circuit 340 turns off the connection between the data line 150 and the two second switch circuits 220; likewise, when the fourth switch circuit 340 works, the third switch circuit 330 does not work, namely, when the fourth switch circuit 340 turns on the connection between the data line 150 and the two second switch circuits 220, the third switch circuit 330 turns off the connection between the data line 150 and the two first switch circuits 210.

In the embodiments, two columns of sub-pixels corresponding to one data line 150 include one odd-numbered column of sub-pixels and one even-numbered column of sub-pixels. As shown in FIG. 3, it is assumed that two first signal lines 130 coupled to the third switch circuit 330 include a first signal line 130A connected to sub-pixels located in odd-numbered rows and the one odd-numbered column, and a first signal line 130B connected to sub-pixels located in odd-numbered rows and the one even-numbered column. The two second signal lines 140 coupled to the fourth switch circuit 340 include a second signal line 140A connected to sub-pixels located in even-numbered rows and the one odd-numbered column, and a second signal line 140B connected to sub-pixels located in even-numbered rows and the one even-numbered column. Thus, a relation between the switch circuits required to be turned on and the sub-pixels at respective positions is as follows:

when providing a data signal to the sub-pixels located in the odd-numbered rows and the odd-numbered columns, it is required to control the third switch circuit 330 and the first switch circuit 210A coupled to the first signal line 130A to be turned on;

when providing a data signal to the sub-pixels located in the odd-numbered rows and the even-numbered columns, it is required to control the third switch circuit 330 and the first switch circuit 210B coupled to the first signal line 130B to be turned on;

when providing a data signal to the sub-pixels located in even-numbered rows and odd-numbered columns, it is required to control the fourth switch circuit 340 and the second switch circuit 220A coupled to the second signal line 140A to be turned on; and when providing a data signal to the sub-pixels located in even-numbered rows and even-numbered columns, it is required to control the fourth switch circuit 340 and the second switch circuit 220B coupled to the second signal line 140B to be turned on.

Further, as shown in FIG. 3, the pixel circuitry may further include a first control signal line 301, a second control signal line 302, a third control signal line 303 and a fourth control signal line 304, which extend in the first direction.

The first control signal line 301 is electrically coupled to the control terminal of the third switch circuit 330 of each data line 150.

The second control signal line 302 is electrically coupled to the control terminal of the fourth switch circuit 340 of each data line 150.

The third control signal line 303 is electrically coupled to control terminals of the first switch circuits 210A coupled to sub-pixels located in the odd-numbered rows and the odd-numbered columns, and control terminals of the second switch circuits 220B coupled to sub-pixels located in the even-numbered rows and the even-numbered columns.

The fourth control signal line 304 is electrically coupled to the control terminal of the second switch circuit 220A coupled to the sub-pixels located in the even-numbered rows and the odd-numbered columns, and the control terminal of the first switch circuit 210B coupled to the sub-pixels located in the odd-numbered rows and the even-numbered columns.

According to a relation between sub-pixels at respective positions and the switch circuits in the embodiment, and the above-mentioned connection relation between each control signal line and the switch circuit, it can be obtained that:

when providing a data signal to the sub-pixels located in the odd-numbered rows and the odd-numbered columns, the first control signal line 301 is required to provide a turn-on signal to a third switch circuit 330, and the third control signal line 303 is required to provide the turn-on signal to the first switch circuit 210A, so that the first signal line 130A is conductive with the data line 150;

when providing a data signal to the sub-pixels located in the odd-numbered rows and the even-numbered columns, the first control signal line 301 is required to provide the turn-on signal to the third switch circuit 330, and the fourth control signal line 304 is required to provide the turn-on signal to the first switch circuit 210B, so that the first signal line 130B is conductive with the data line;

when providing a data signal to the sub-pixels located in the even-numbered rows and the odd-numbered columns, the second control signal line 302 is required to provide the turn-on signal to the fourth switch circuit 340, and the fourth control signal line 304 is required to provide the turn-on signal to the second switch circuit 220A, so that the second signal line 140A is conductive with the data line; and when providing a data signal to the sub-pixels located in even-numbered rows and odd-numbered columns, the second control signal line 302 is required to provide the turn-on signal to the fourth switch circuit 340, and the third control signal line 303 is required to provide the turn-on signal to the second switch circuit 220B, so that the second signal line 140B is conductive with the data line.

Figure 4:
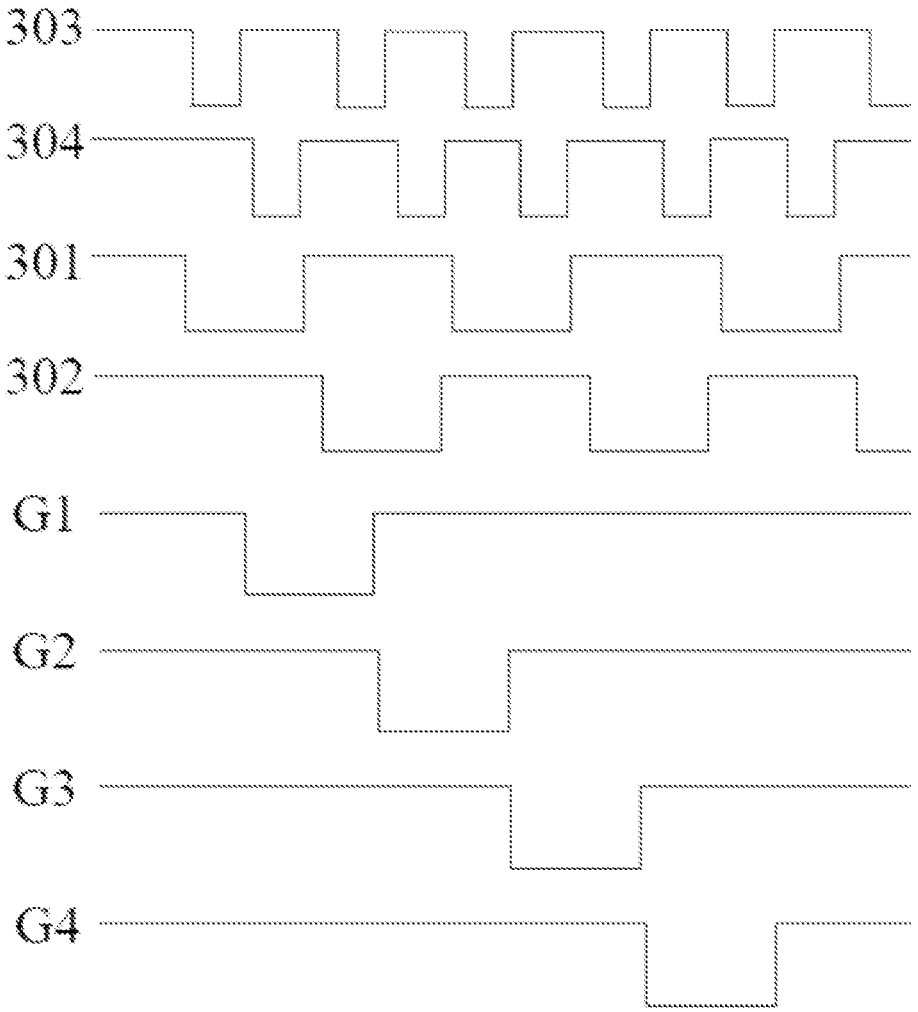
FIG. 4 is a timing control diagram of each gate line and each control signal line in FIG. 3.

A diagram of signal sequences of the first control signal line 301, the second control signal line 302, the third control signal line 303, the fourth control signal line 304 and various gate lines are shown in FIG. 4.

Figure 5:
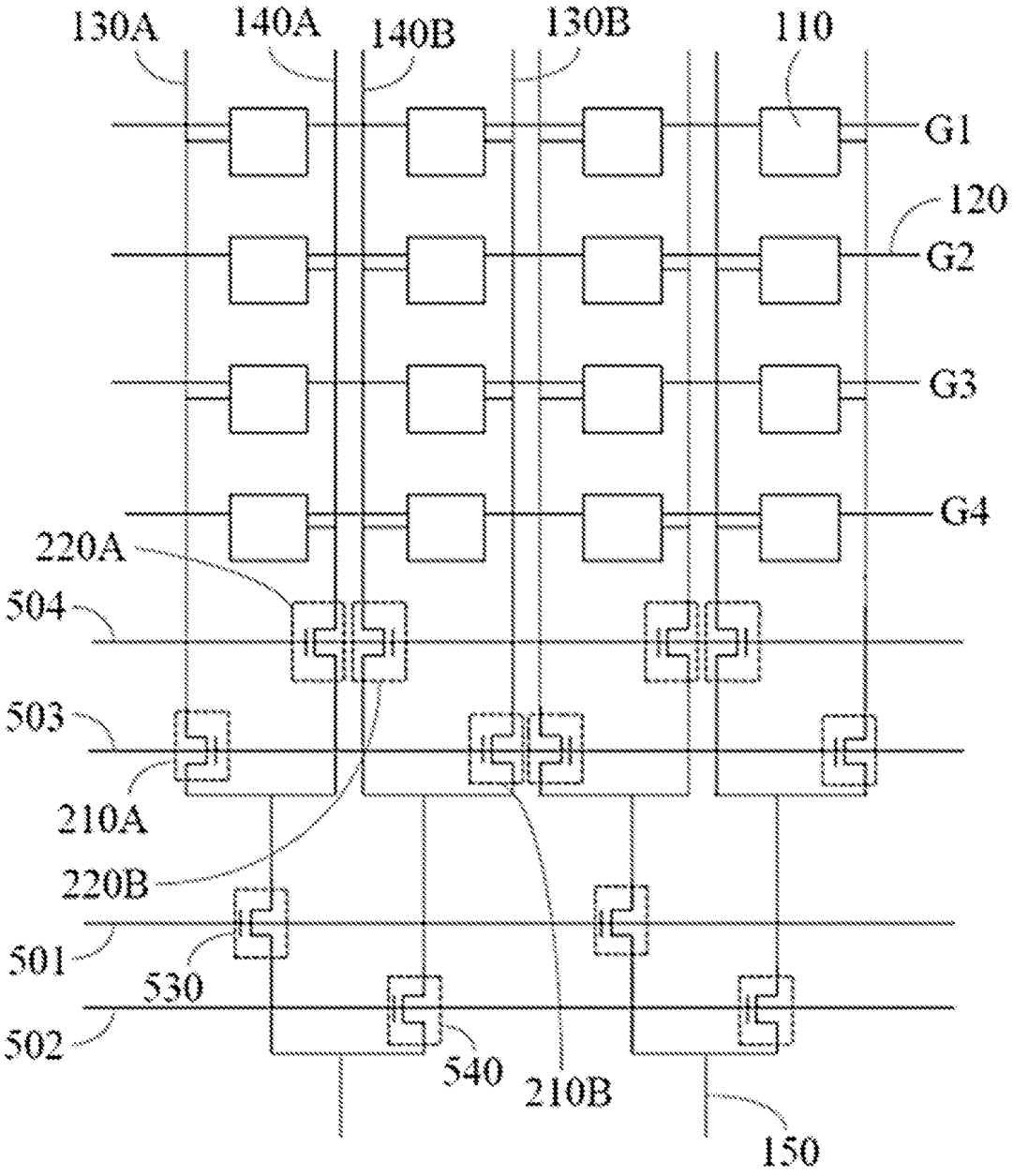
FIG. 5 is a schematic structural diagram of a pixel circuitry provided by another embodiment of the present disclosure.

In another optional embodiment, as shown in FIG. 5, two first signal lines 130 or two second signal lines 140 are provided between any two adjacent columns of sub-pixels.

As shown in FIG. 5, among two columns of sub-pixels corresponding to each data line 150, a fifth switch circuit 530 is further provided between the each data line and the first switch circuit 210A and the second switch circuit 220A that are coupled to one column of sub-pixels, and, a sixth switch circuit 540 is further provided between the each data line 150 and the first switch circuit 210B and the second switch circuit 220B that are coupled to the other column of sub-pixels. The fifth switch circuit 530 is configured to control connection or disconnection between the data line 150, and the first switch circuit 210A or second switch circuit 220A that is coupled to the fifth switch circuit; and the sixth switch circuit 540 is configured to control connection or disconnection between the data line 150, and the first switch circuit 210B or second switch circuit 220B that is coupled to the sixth switch circuit.

In the embodiment, connections or disconnections between the four signal lines and the data line are controlled by two-stage switches. Specifically, a first terminal of the fifth switch circuit 530 is electrically coupled to the data line 150, and a second terminal of the fifth switch circuit 530 is electrically coupled to first terminals of the first switch circuit 210A and the second switch circuit 220A; a first terminal of the sixth switch circuit 540 is electrically coupled to the data line 150, and a second terminal of the sixth switch circuit 540 is electrically coupled to first terminals of the first switch circuit 210B and the second switch circuit 220B.

When the fifth switch circuit 530 works, the sixth switch circuit 540 does not work, namely, when the fifth switch circuit 530 conducts the electrical connection between the data line 150 and the first terminal of the first switch circuit 210A and the first terminal of the second switch circuit 220A, the sixth switch circuit 540 turns off the connection between the data line 150 and the first terminal of the first switch circuit 210B and the first terminal of the second switch circuit 220B; likewise, when the sixth switch circuit 540 works, the fifth switch circuit 530 does not work, namely, when the sixth switch circuit 540 conducts the connection between the data line 150 and the first terminal of the first switch circuit 210B and the first terminal of the second switch circuit 220B, the fifth switch circuit 530 turns off the connection between the data line 150 and the first terminal of the first switch circuit 210A and the first terminal of the second switch circuit 220A.

In the embodiments, two columns of sub-pixels corresponding to one data line include one odd-numbered column of sub-pixels and one even-numbered column of sub-pixels. As shown in FIG. 5, it is assumed that the first signal line 130 and the second signal line 140 coupled to the fifth switch circuit 530 include the first signal line 130A for connecting sub-pixels located in the odd-numbered rows and the odd-numbered columns, and the second signal line 140A for connecting sub-pixels located in the even-numbered rows and the odd-numbered columns. The first signal line 130 and the second signal line 140 coupled to the sixth switch circuit 540 include the first signal line 130B for connecting sub-pixels located in the odd-numbered rows and the even-numbered columns, and the second signal line 140B for connecting sub-pixels located in the even-numbered rows and the even-numbered columns. Thus, a relation between the switch circuits required to be turned on and the sub-pixels at respective positions is as follows:

when providing a data signal to the sub-pixels located in the odd-numbered rows and the odd-numbered columns, it is required to control the fifth switch circuit 530 and the first switch circuit 210A coupled to the first signal line 130A to be turned on;

when providing a data signal to the sub-pixels located in the odd-numbered rows and the even-numbered columns, it is required to control the fourth switch circuit 540 and the first switch circuit 210B coupled to the first signal line 130B to be turned on;

when providing a data signal to the sub-pixels located in the even-numbered rows and the odd-numbered columns, it is required to control the third switch circuit 530 and a second switch circuit 220A coupled to the second signal line 140A to be turned on; and when providing a data signal to the sub-pixels located in even-numbered rows and even-numbered columns, it is required to control the fourth switch circuit 540 and the second switch circuit 220B coupled to the second signal line 140B to be turned on.

Further, as shown in FIG. 5, the pixel circuitry may further include a first control signal line 501, a second control signal line 502, a third control signal line 503, and a fourth control signal line 504, all of which extend in the first direction.

The first control signal line 501 is electrically coupled to the control terminal of the fifth switch circuit 530 of each data line.

The second control signal line 502 is electrically coupled to the control terminal of the sixth switch circuit 540 of each data line.

The third control signal line 503 is electrically coupled to the control terminal of the first switch circuit 210A coupled to the sub-pixels located in the odd-numbered rows and the odd-numbered columns, and the control terminal of the second switch circuit 210B coupled to the sub-pixels located in the even-numbered rows and the even-numbered columns.

The fourth control signal line 504 is electrically coupled to the control terminal of the first switch circuit 220A coupled to the sub-pixels located in the even-numbered rows and the odd-numbered columns, and the control terminal of the second switch circuit 220B coupled to the sub-pixels located in the even-numbered rows and the even-numbered columns.

According to a relation between sub-pixels at respective positions and the switch circuits in the embodiment, and the above-mentioned connection relation between each control signal line and the switch circuit, it can be obtained that:

when providing the data signal to the sub-pixels located in the odd-numbered rows and the odd-numbered columns, the first control signal line 501 is required to provide the turn-on signal to the fifth switch circuit 530, and the third control signal line 503 is required to provide the turn-on signal to the first switch circuit 210A, so that the first signal line 130A is conductive with the data line 150;

when providing the data signal to the sub-pixels located in the odd-numbered rows and the even-numbered columns, the second control signal line 502 is required to provide the turn-on signal to the sixth switch circuit 540, and the third control signal line 503 is required to provide the turn-on signal to the first switch circuit 210B, so that the first signal line 130B is conductive with the data line 150;

when providing the data signal to the sub-pixels located in the even-numbered rows and the odd-numbered columns, the first control signal line 501 is required to provide the turn-on signal to the fifth switch circuit 530, and the fourth control signal line 504 is required to provide the turn-on signal to the second switch circuit 220A, so that the second signal line 140A is conductive with the data line 150; and when providing the data signal to the sub-pixels located in even-numbered rows and odd-numbered columns, the second control signal line 502 is required to provide the turn-on signal to the fourth switch circuit 540, and the fourth control signal line 504 is required to provide the turn-on signal to the second switch circuit 220B, so that the second signal line 140B is conductive with the data line.

Figure 6:
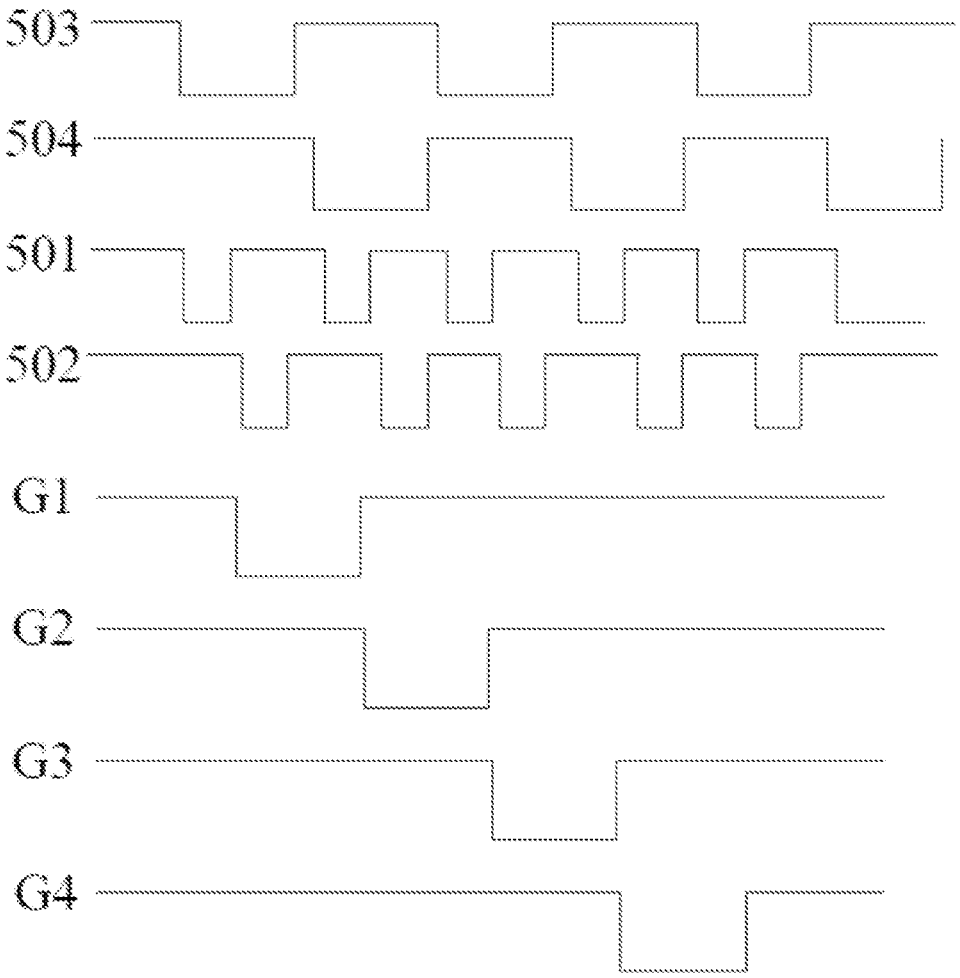
FIG. 6 is a timing control diagram for each gate line and each control signal line in FIG. 5.

A diagram of signal sequences of the first control signal line 501, the second control signal line 502, the third control signal line 503, the fourth control signal line 504, and various gate lines are shown in FIG. 6.

In addition, in the embodiments of the present disclosure, as shown in FIG. 2, FIG. 3, and FIG. 5, at least one of the first switch circuit 210, the second switch circuit 220, the third switch circuit 330, the fourth switch circuit 340, the fifth switch circuit 530, or the sixth switch circuit 540 as mentioned above includes a transistor, a first electrode of the transistor is electrically coupled to the data line, a second electrode of the transistor is electrically coupled to the sub-pixels, and a control electrode of the transistor is electrically coupled to the control signal line.

The transistor may be a triode, a thin film transistor, a field effect transistor, or other components with the same characteristics. In embodiments of the present disclosure, to distinguish two electrodes of a transistor other than the control electrode, one of the electrodes is referred to as a first electrode and the other electrode is referred to as a second electrode.

In actual operation, when a transistor is a triode, the control electrode may be a base electrode, the first electrode may be a collector electrode, and the second electrode may be an emitter electrode; alternatively, the control electrode may be a base electrode, the first electrode may be an emitter electrode, and the second electrode may be a collector electrode.

In actual operation, when the transistor is a thin film transistor or a field effect transistor, the control electrode may be a gate, the first electrode may be a drain, and the second electrode may be a source; and alternatively, the control electrode may be a gate, the first electrode may be a source, and the second electrode may be a drain.

In addition, in the relevant technologies, assuming that there are N rows of sub-pixels arranged in an array, each data line needs to refresh a voltage for N times in one frame of a display period; and when the screen resolution is large, N is large, the refresh speed of the voltage on the data line is too fast, and the compensation time is short. This leads to the problem that a threshold voltage Vth compensation capability in a pixel compensation circuit is insufficient.

However, in the embodiments of the present disclosure, sub-pixels in the same column are electrically coupled to the data line 150 via the first signal line 130 and the second signal line 140. In such a manner, the first signal line 130 coupled to the sub-pixels located in the odd-numbered rows refreshes the voltage for N/2 times in one frame of display period, and similarly, the second signal line 140 coupled to the sub-pixels located in the even-numbered rows refreshes the voltage for N/2 times in one frame of display period. The compensation time is extended as compared with the relevant technologies, thereby avoiding the problem that the pixel compensation circuit has insufficient capability for compensating the threshold voltage Vth, so as to improve the display quality of a display device.

Another embodiment of the present disclosure further provides a display device including the display panel as described above.

The display device may be a display, a cell phone, a tablet computer, a television, a wearable electronic device, a navigation display device, etc.

Embodiments of the present disclosure also provide a method for driving a pixel circuitry, which is applied to the pixel circuitry as described above. The method includes: providing, by the plurality of gate lines in a time-sharing manner, gate scanning signals to sub-pixels located in different rows, where the providing one of the gate scanning signals to one row of sub-pixels includes: providing, by each of the data lines in the time-sharing manner, corresponding data signals to two sub-pixels in the one row of sub-pixels via a first signal line or a second signal line coupled to the data line.

In the embodiments of the present disclosure, all the sub-pixels located in odd-numbered rows and the same column are electrically coupled to the same first signal line, all the sub-pixels located in even-numbered rows and the same column are electrically coupled to the same second signal line, and two first signal lines and two second signal lines coupled to sub-pixels located in each two adjacent columns are all electrically coupled to the same data line, so that each data line can charge two columns of sub-pixels, thereby avoiding the situation that the number of channels is insufficient when the IC provides data signals and facilitating the development of display devices with high resolution. Therefore, the technical solutions provided by the present disclosure can avoid the situation of insufficient number of channels when data signals are supplied by the IC, thereby facilitating the development of the display devices with a high resolution.

As shown in FIG. 1, the above plurality of sub-pixels 110 arranged in an array may be a plurality of sub-pixels of different colors arranged in the array on a substrate according to a preset sequence, and may include a red sub-pixel, a green sub-pixel, and a blue sub-pixel, and certainly may also include sub-pixels of other colors, for example, white sub-pixels, yellow sub-pixels, etc., which are not limited herein.

The number of the above-mentioned gate lines 120 is equal to the number of rows of the sub-pixels 110 arranged in the array, and multiple rows of sub-pixels are coupled to the gate lines 120 in one-to-one manner. In an embodiment of the present disclosure, the first direction is the same as the row direction in which the sub-pixels 110 are arranged.

The number of the above-mentioned first signal lines 130 is equal to the number of the above-mentioned second signal lines 140, and is equal to the number of columns of the sub-pixels 110 arranged in the array. For each column of sub-pixels, the sub-pixels located in the odd-numbered rows are electrically coupled to the first signal line 130, and the sub-pixels located in the even-numbered rows are electrically coupled to the second signal line 140. In an embodiment of the present disclosure, the second direction is the same as the column direction in which the sub-pixels 110 are arranged.

The above-mentioned data lines 150 are located at one side of the plurality of sub-pixels arranged in the array in the column direction, and each data line 150 is coupled to two first signal lines 130 and two second signal lines 140 through a node; the four coupled signal lines provide data signals to each sub-pixels of the two columns of sub-pixels corresponding to the data line 150.

The four signal lines coupled to the same data line 150 transmit a data signal Vdata on the data line 150 in a time-divided way, namely, one signal line obtains the data signal Vdata on the data line 150, while the other three signal lines do not obtain the data signal Vdata on the data line 150.

In an optional embodiment of the present disclosure, as shown in FIG. 2, a first switch circuit 210 is provided between each data line 150 and the first signal line 130 coupled to the data line, and a second switch circuit 220 is provided between each data line 150 and the second signal line 140 coupled to the data line. Each first switch circuit 210 is configured to control connection or disconnection between the data line 150 and the first signal line 130 that are coupled to the first switch circuit; and each second switch circuit 220 is configured to control connection or disconnection between the data line 150 and the second signal line 140 that are coupled to the second switch circuit.

Namely, in the embodiments, a first terminal of each first switch circuit 210 is electrically coupled to the data line 150, and a second terminal is electrically coupled to the first signal line 130; and a first terminal of each second switch circuit 220 is electrically coupled to the data line 150, and a second terminal is electrically coupled to the second signal line 140. One of the data lines 150 is connected to two of the first switch circuits 210 and two of the second switch circuits 220.

Four switch circuits operate in a time-sharing manner, one of the switch circuits operating refers to conducting the connection between the data line 150 and the first signal line 130 or the second signal line 140 that are connected to the one switch circuit; the other switch circuits disconnect the coupled data lines 150 from the first signal lines 130 or second signal lines 140 that are connected to the other switch circuits, thereby to realize that the four signal lines transmit the data signal Vdata on the data line 150 in the time-sharing manner.

In an optional embodiment, applied to the pixel circuitry as shown in FIG. 3, the method includes the following steps:

in case of providing the gate scanning signals to an odd-numbered row of sub-pixels, the providing, by each of the data lines in the time-sharing manner, corresponding data signals to two sub-pixels in the row of sub-pixels via a first signal line or a second signal line coupled to the data line includes:

controlling the first control signal line to send a turned-on signal to the control terminal of the third switch circuit, and simultaneously controlling the third control signal line to send a turned-on signal to the control terminal of the first switch circuit, to enable the data signals to be written into sub-pixels located in the odd-numbered row and the odd-numbered columns; and controlling the first control signal line to send the turned-on signal to the control terminal of the third switch circuit, and simultaneously controlling the fourth control signal line to send the turned-on signal to the control terminal of the first switch circuit, to enable the data signals to be written into sub-pixels located in the odd-numbered row and the even-numbered columns, or, in case of providing the gate scanning signals to an even-numbered row of sub-pixels, the providing, by each of the data lines in the time-sharing manner, corresponding data signals to two sub-pixels in the row of sub-pixels via a first signal line or a second signal line coupled to the data line includes:

controlling the second control signal line to send a turned-on signal to the control terminal of the fourth switch circuit, and simultaneously controlling the fourth control signal line to send a turned-on signal to the control terminal of the second switch circuit, to enable the data signals to be written into sub-pixels located in the even-numbered row and the odd-numbered columns; and controlling the second control signal line to send the turn-on signal to the control terminal of the fourth switch circuit, and simultaneously controlling the third control signal line to send the turn-on signal to the control terminal of the second switch circuit, to enable the data signals to be written to sub-pixels located in the even-numbered row and even-numbered columns.

In the embodiments, connections or disconnections between the four signal lines and the data line are controlled by two-stage switches. Specifically, a first terminal of the third switch circuit 330 is electrically coupled to the data line 150, and a second terminal of the third switch circuit 330 is electrically coupled to first terminals of the two first switch circuits 210; a first terminal of the fourth switch circuit 340 is electrically coupled to the data line 150, and a second terminal of the fourth switch circuit 340 is electrically coupled to first terminals of the two second switch circuits 220.

When the third switch circuit 330 works, the fourth switch circuit 340 does not work, namely, when the third switch circuit 330 turns on the connection between the data line 150 and the two first switch circuits 210, the fourth switch circuit 340 turns off the connection between the data line 150 and the two second switch circuits 220; likewise, when the fourth switch circuit 340 works, the third switch circuit 330 does not work, namely, when the fourth switch circuit 340 turns on the connection between the data line 150 and the two second switch circuits 220, the third switch circuit 330 turns off the connection between the data line 150 and the two first switch circuits 210.

In case of providing the gate scanning signals to odd-numbered rows of sub-pixels, the method includes: when providing a data signal to the sub-pixels located in the odd-numbered rows and the odd-numbered columns, the first control signal line 301 is required to provide a turn-on signal to a third switch circuit 330, and the third control signal line 303 is required to provide the turn-on signal to the first switch circuit 210A, so that the first signal line 130A is conductive with the data line 150; and when providing a data signal to the sub-pixels located in the odd-numbered rows and the even-numbered columns, the first control signal line 301 is required to provide the turn-on signal to the third switch circuit 330, and the fourth control signal line 304 is required to provide the turn-on signal to the first switch circuit 210B, so that the first signal line 130B is conductive with the data line.

In case of providing the gate scanning signals to even-numbered rows of sub-pixels, the method includes: when providing a data signal to the sub-pixels located in the even-numbered rows and the odd-numbered columns, the second control signal line 302 is required to provide the turn-on signal to the fourth switch circuit 340, and the fourth control signal line 304 is required to provide the turn-on signal to the second switch circuit 220A, so that the second signal line 140A is conductive with the data line; and when providing a data signal to the sub-pixels located in even-numbered rows and odd-numbered columns, the second control signal line 302 is required to provide the turn-on signal to the fourth switch circuit 340, and the third control signal line 303 is required to provide the turn-on signal to the second switch circuit 220B, so that the second signal line 140B is conductive with the data line.

A diagram of signal sequences of the first control signal line 301, the second control signal line 302, the third control signal line 303, the fourth control signal line 304 and various gate lines are shown in FIG. 4.

In another optional embodiment, applied to the pixel circuitry as shown in FIG. 5, the method includes following steps:

in case of providing the gate scanning signals to an odd-numbered row of sub-pixels, the providing, by each of the data lines in the time-sharing manner, corresponding data signals to two sub-pixels in the row of sub-pixels via a first signal line or a second signal line coupled to the data line includes:

controlling the first control signal line to send a turn-on signal to the control terminal of the fifth switch circuit, and simultaneously controlling the third control signal line to send a turn-on signal to the control terminal of the first switch circuit, to enable the data signals to be written into sub-pixels located in the odd-numbered row and the odd-numbered columns; and controlling the second control signal line to send the turn-on signal to the control terminal of the sixth switch circuit, and simultaneously controlling the third control signal line to send the turn-on signal to the control terminal of the first switch circuit, to enable the data signals to be written into sub-pixels located in the odd-numbered row and the even-numbered columns, or, in case of providing the gate scanning signals to an even-numbered row of sub-pixels, the providing, by each of the data lines in the time-sharing manner, corresponding data signals to two sub-pixels in the row of sub-pixels via a first signal line or a second signal line coupled to the data line includes:

controlling the first control signal line to send a turn-on signal to the control terminal of the fifth switch circuit, and simultaneously controlling the fourth control signal line to send a turn-on signal to the control terminal of the second switch circuit, to enable the data signals to be written into sub-pixels located in the even-numbered row and the odd-numbered columns; and controlling the second control signal line to send the turn-on signal to the control terminal of the sixth switch circuit, and simultaneously controlling the fourth control signal line to send the turn-on signal to the control terminal of the second switch circuit, to enable the data signals to be written to sub-pixels located in the even-numbered row and the even-numbered columns.

In the embodiment, connections or disconnections between the four signal lines and the data line are controlled by two-stage switches. Specifically, a first terminal of the fifth switch circuit 530 is electrically coupled to the data line 150, and a second terminal of the fifth switch circuit 530 is electrically coupled to first terminals of the first switch circuit 210A and the second switch circuit 220A; a first terminal of the sixth switch circuit 540 is electrically coupled to the data line 150, and a second terminal of the sixth switch circuit 540 is electrically coupled to first terminals of the first switch circuit 210B and the second switch circuit 220B.

When the fifth switch circuit 530 works, the sixth switch circuit 540 does not work, namely, when the fifth switch circuit 530 conducts the electrical connection between the data line 150 and the first terminal of the first switch circuit 210A and the first terminal of the second switch circuit 220A, the sixth switch circuit 540 turns off the connection between the data line 150 and the first terminal of the first switch circuit 210B and the first terminal of the second switch circuit 220B; likewise, when the sixth switch circuit 540 works, the fifth switch circuit 530 does not work, namely, when the sixth switch circuit 540 conducts the connection between the data line 150 and the first terminal of the first switch circuit 210B and the first terminal of the second switch circuit 220B, the fifth switch circuit 530 turns off the connection between the data line 150 and the first terminal of the first switch circuit 210A and the first terminal of the second switch circuit 220A.

In the case of providing the gate scanning signals to odd-numbered rows of sub-pixels, following steps are included: when providing the data signal to the sub-pixels located in the odd-numbered rows and the odd-numbered columns, the first control signal line 501 is required to provide the turn-on signal to the fifth switch circuit 530, and the third control signal line 503 is required to provide the turn-on signal to the first switch circuit 210A, so that the first signal line 130A is conductive with the data line 150; and when providing the data signal to the sub-pixels located in the odd-numbered rows and the even-numbered columns, the second control signal line 502 is required to provide the turn-on signal to the sixth switch circuit 540, and the third control signal line 503 is required to provide the turn-on signal to the first switch circuit 210B, so that the first signal line 130B is conductive with the data line 150;

In the case of providing the gate scanning signals to even-numbered rows of sub-pixels, following steps are included: when providing the data signal to the sub-pixels located in the even-numbered rows and the odd-numbered columns, the first control signal line 501 is required to provide the turn-on signal to the fifth switch circuit 530, and the fourth control signal line 504 is required to provide the turn-on signal to the second switch circuit 220A, so that the second signal line 140A is conductive with the data line 150; and when providing the data signal to the sub-pixels located in even-numbered rows and odd-numbered columns, the second control signal line 502 is required to provide the turn-on signal to the fourth switch circuit 540, and the fourth control signal line 504 is required to provide the turn-on signal to the second switch circuit 220B, so that the second signal line 140B is conductive with the data line.

A diagram of signal sequences of the first control signal line 501, the second control signal line 502, the third control signal line 503, the fourth control signal line 504, and various gate lines are shown in FIG. 6.

It is noted that in the specification, such terms as "comprise", "include", or any other variation thereof are intended to cover a non-exclusive inclusion, such that a process, method, article, or device that comprises a list of elements not only includes those listed elements, but also includes other elements not expressly listed or inherent to such process, method, article, or device. If there are no more constraints, an element defined by a sentence "comprising a . . . " does not preclude the existence of additional identical elements in the process, method, article, or device that comprises the element.

The above-mentioned embodiments are just optional implementations of the present disclosure. It should be noted that those skilled in the art can make various improvements and modifications without departing from the principle of the present disclosure, and theses improvement and modifications shall fall within the protection scope of the present disclosure.

What is claimed is:

1. A pixel circuitry, comprising:

a plurality of sub-pixels arranged in an array;

a plurality of gate lines extending in a first direction, wherein all sub-pixels located in a same row are electrically coupled to a same one of the gate lines;

a plurality of first signal lines and a plurality of second signal lines that extend in a second direction, wherein all sub-pixels located in odd-numbered rows and a same column are electrically coupled to a same one of the first signal lines, and all sub-pixels located in even-numbered rows and a same column are electrically coupled to a same one of the second signal lines, the second direction being perpendicular to the first direction; and a plurality of data lines extending in the second direction, wherein two of the first signal lines and two of the second signal lines that are coupled to two adjacent columns of the sub-pixels are electrically coupled to a same one of the data lines; and wherein a first switch circuit is provided between each of the data lines and one of the first signal lines coupled to the data line, and a second switch circuit is provided between each of the data lines and one of the second signal lines coupled to the data line;

each first switch circuit is configured to control connection or disconnection between the data line and the first signal line that are coupled; and each second switch circuit is configured to control connection or disconnection between the data line and the second signal line that are coupled;

wherein one of the first signal lines and one of the second signal lines are provided between two adjacent columns of sub-pixels; and wherein a third switch circuit is further provided between the two first switch circuits coupled to a same data line of the data lines and the data line, and a fourth switch circuit is further provided between the two second switch circuits coupled to a same data line of the data lines and the data line;

the third switch circuit is configured to control connection or disconnection between the data line and the two first switch circuits; and the fourth switch circuit is configured to control connection or disconnection between the data line and the two second switch circuits.

2. The pixel circuitry according to claim 1, further comprising four control signal lines extending in the first direction, wherein two of the control signal lines are respectively electrically coupled to control terminals of two first switch circuits coupled to a same data line of the data lines, and the other two control signal lines are respectively electrically coupled to control terminals of two second switch circuits coupled to a same data line of the data lines; and the four control signal lines are configured to control, in a time-sharing manner, connection or disconnection between each data line and the first signal lines or the second signal lines that are coupled to the data line.

3. The pixel circuitry according to claim 1, further comprising a first control signal line, a second control signal line, a third control signal line, and a fourth control signal line that extend in the first direction, wherein:

the first control signal line is electrically coupled to a control terminal of the third switch circuit of each data line;

the second control signal line is electrically coupled to a control terminal of the fourth switch circuit of each data line;

the third control signal line is electrically coupled to control terminals of first switch circuits coupled to sub-pixels located in the odd-numbered rows and the odd-numbered columns, and to control terminals of second switch circuits coupled to sub-pixels located in the even-numbered rows and the even-numbered columns; and the fourth control signal line is electrically coupled to control terminals of the second switch circuit coupled to sub-pixels located in the even-numbered rows and the odd-numbered columns, and to control terminals of first switch circuits coupled to sub-pixels located in the odd-numbered rows and the even-numbered columns.

4. A method for driving a pixel circuitry, wherein the method is applied to the pixel circuitry according to claim 3, the method comprising:

providing, by the plurality of gate lines in a time-sharing manner, gate scanning signals to sub-pixels located in different rows, wherein the providing the gate scanning signals to a row of sub-pixels comprises: providing, by each of the data lines in the time-sharing manner, corresponding data signals to two sub-pixels in the row of sub-pixels via a first signal line or a second signal line coupled to the data line.

5. The method according to claim 4, wherein:

in case of providing the gate scanning signals to an odd-numbered row of sub-pixels, the providing, by each of the data lines in the time-sharing manner, corresponding data signals to two sub-pixels in the row of sub-pixels via a first signal line or a second signal line coupled to the data line comprises:

controlling the first control signal line to send a turned-on signal to the control terminal of the third switch circuit, and simultaneously controlling the third control signal line to send a turned-on signal to the control terminal of the first switch circuit, to enable the data signals to be written into sub-pixels located in the odd-numbered row and the odd-numbered columns; and controlling the first control signal line to send the turned-on signal to the control terminal of the third switch circuit, and simultaneously controlling the fourth control signal line to send the turned-on signal to the control terminal of the first switch circuit, to enable the data signals to be written into sub-pixels located in the odd-numbered row and the even-numbered columns, or, in case of providing the gate scanning signals to an even-numbered row of sub-pixels, the providing, by each of the data lines in the time-sharing manner, corresponding data signals to two sub-pixels in the row of sub-pixels via a first signal line or a second signal line coupled to the data line comprises:

controlling the second control signal line to send a turned-on signal to the control terminal of the fourth switch circuit, and simultaneously controlling the fourth control signal line to send a turned-on signal to the control terminal of the second switch circuit, to enable the data signals to be written into sub-pixels located in the even-numbered row and the odd-numbered columns; and controlling the second control signal line to send the turn-on signal to the control terminal of the fourth switch circuit, and simultaneously controlling the third control signal line to send the turn-on signal to the control terminal of the second switch circuit, to enable the data signals to be written to sub-pixels located in the even-numbered row and even-numbered columns.

6. The pixel circuitry according to claim 1, wherein two of the first signal lines or two of the second signal lines are provided between two adjacent columns of sub-pixels.

7. The pixel circuitry according to claim 1, wherein at least one of the first switch circuit, the second switch circuit, the third switch circuit or the fourth switch circuit comprises a transistor, a first electrode of the transistor is electrically coupled to the data line, a second electrode of the transistor is electrically coupled to the sub-pixels, and a control electrode of the transistor is electrically coupled to a control signal line.

8. A display device, comprising the pixel circuitry according to claim 1.

9. A method for driving a pixel circuitry, wherein the method is applied to the pixel circuitry according to claim 1, the method comprising:

providing, by the plurality of gate lines in a time-sharing manner, gate scanning signals to sub-pixels located in different rows, wherein the providing the gate scanning signals to a row of sub-pixels comprises: providing, by each of the data lines in the time-sharing manner, corresponding data signals to two sub-pixels in the row of sub-pixels via a first signal line or a second signal line coupled to the data line.

* * * * *